United States Patent [19]

Kleinke

[11] Patent Number: 4,791,743

[45] Date of Patent: Dec. 20, 1988

[54] WEARING APPAREL DEVICE AND METHOD OF USING SAME

[76] Inventor: Bernard L. Kleinke, 12903 Texana St., San Diego, Calif. 92129

[21] Appl. No.: 117,505

[22] Filed: Nov. 6, 1987

[51] Int. Cl.[4] ..... G09F 3/00

[52] U.S. Cl. ..... 40/322; 223/DIG. 1

[58] Field of Search ..... 40/322; 223/85, 87, 223/88, 92, 98, DIG. 1; 206/281, 274

[56] References Cited

U.S. PATENT DOCUMENTS

D. 204,342 4/1966 Larkin ..... 223/85
2,492,226 12/1949 Kohl et al. ..... 223/DIG. 1
3,124,284 3/1964 Collum ..... 40/322
3,783,995 1/1974 Tobin ..... 206/281

*Primary Examiner*—Gene Mancene
*Assistant Examiner*—Michael Lynch

[57] ABSTRACT

A wearing apparel device and a method of using it, includes a plate depending from a clothes hanger. A support device on the plate attaches a group of neckties to the hanger in a pre-determined separated manner. A group of garment indicia devices are disposed adjacent to the support device for indicating other garments to be worn with each individual necktie being attached to the hanger at individual necktie locations.

13 Claims, 1 Drawing Sheet

WEARING APPAREL DEVICE AND METHOD OF USING SAME

TECHNICAL FIELD

The present invention relates to a wearing apparel coordinating system, and a method of using it to help the user to select the proper combinations of garments for an aesthetically pleasing combination thereof. It more particularly relates to a system and method of using it to assist the user in the proper color coordination of garments to be worn.

BACKGROUND ART

It has become popular for people to coordinate the colors of various articles of wearing apparel to provide an aesthetically pleasing appearance of the combination of the garments to be worn at the same time. For example, a suit, a shirt and a necktie are selected for their particular colors to have them complement one another, so that when the wearer is wearing all three items, they provide an attractive appearance for the wearer.

The problem of color coordination arises when there are a number of ties that can be worn with a given suit, and each necktie has one or more different shirts that can be worn with the combination. The average person, who may not possess the necessary artistic ability to properly coordinate a wardrobe, may find it difficult to match the proper necktie and shirt with a given suit. This is particularly true where there are a variety of ties and shirts in a person's wardrobe for a given suit. Such a person, after selecting a given suit, must then choose amongst a variety of shirts and a variety of ties to achieve the desired attractive color coordination for the given suit.

Even though a person may possess a large number of shirts and ties for each suit, a person will ordinarily select the same combinations of garments which are his or her favorites. In this regard, one does not always remember all of the various combinations, and therefore naturally tends to use the same shirt and necktie with a given suit. Therefore, the wear and tear on the garments is not distributed uniformly amongst the garments of the wardrobe and therefore the popular items wear out prematurely, and thus must be discarded and replaced. As a result, there is an unnecessary and unwanted economic loss.

DISCLOSURE OF INVENTION

It is therefore the principal object of this invention to provide a wearing apparel coordinating system and method of using it, which provides a simple, inexpensive and practical way of helping select properly coordinated wearing apparel for various occasions.

Briefly, the above and further objects of the present invention are realized by providing a new wearing apparel coordinating system, and a method of using it, which enable the user to readily coordinate garments and to distribute their wear uniformly.

Such wearing apparel coordinating system, includes a plate depending from a clothes hanger. A support device on the plate attaches a group of neckties to the hanger in a pre-determined separated manner. A group of garment indicia devices are disposed adjacent to the support device for indicating other garments to be worn with each individual necktie being attached to the hanger at individual necktie locations.

BRIEF DESCRIPTION OF DRAWINGS

The above mentioned and other objects and features of this invention and the manner of attaining them will become apparent, and the invention itself will be best understood by reference to the following description of an embodiment of the invention in conjunction with the accompanying drawings, wherein.

BEST MODE FOR CARRYING OUT THE INVENTION

Figure 1:
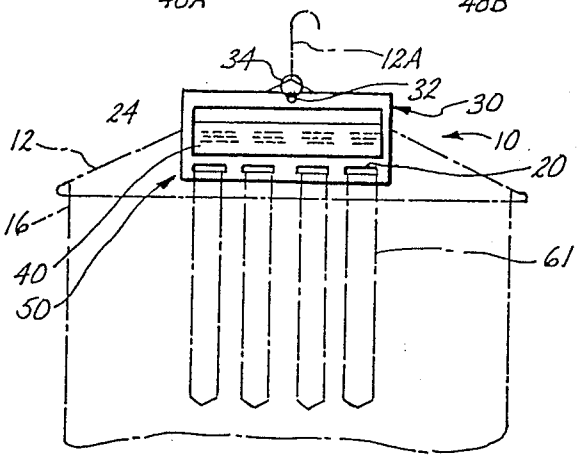
FIG. 1 is the front elevational view of a wearing apparel coordinating system, which is constructed according to the present invention.

Referring now to the drawings and more particularly to FIG. 1 thereof, there is shown a wearing apparel coordinating system 10, which is constructed in accordance with the present invention. The system 10 is adapted to be used with a suit hanger 12 on which a jacket (not shown) and trousers 16 are hung. A hook 12A of the hanger 12 is adapted to be slipped over a clothes pole (not shown) or the like for supporting the hanger from above.

The system 10 includes a thin flat plate 30, which has a flexible cord or loop 34 encircles the hook 12A to support or hang the plate 30 therefrom. A hole 32 in the upper portion of the plate 30 receives the loop 34. The plate 30 hangs in front of the hanger 12 with the jacket (not shown) and trousers 16 supported on the hanger 12. The front side of the sheet plate 30 carries a label 24 facing the user of the apparel. The label 24 has an adhesive (not shown) on the back face (not shown) thereof to secure the label to the front face of the plate 00.

Figure 2:
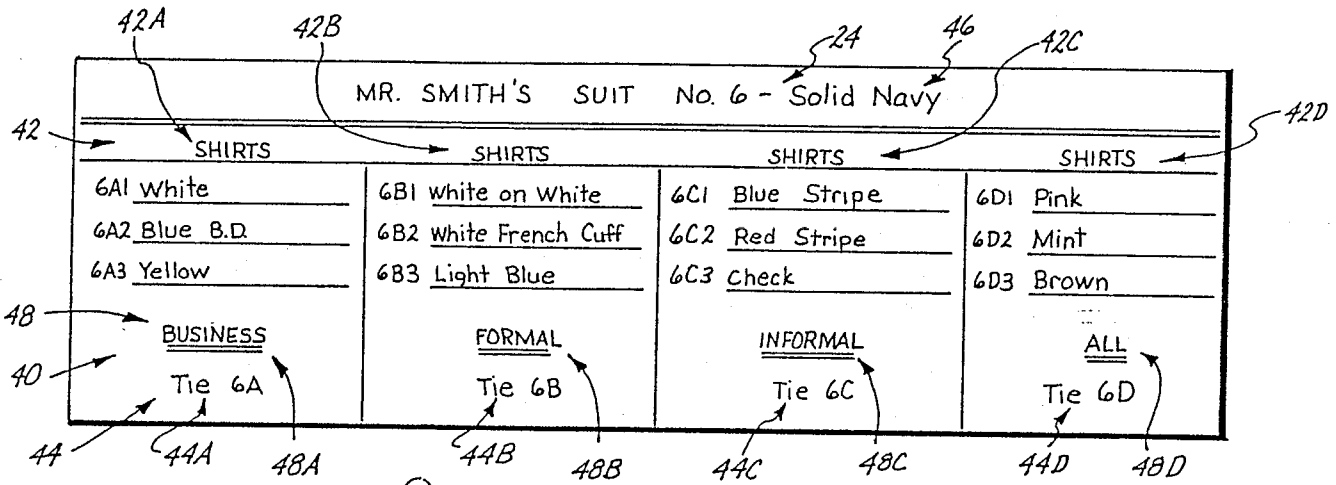
FIG. 2 is a greatly enlarged front face view of an indicia device of the system of FIG. 1.

On the front face of the label 24, there is disposed printed garment indicia generally indicated at 40, shown in greater detail in FIG. 2. On the lower portion of the plastic sheet plate 20 is a necktie supporting device 50, which comprises a series of four slots such as slot 20. Each slot is an elongated opening sufficiently large enough to receive a necktie, such as the necktie 61 threaded through the slot 20 and are suspended therefrom. As will become apparent to those skilled in the art, a greater or fewer number of such slots may be employed. Each necktie is permanently assigned to a certain slot in accordance with the practice of this invention. In this manner, the ties are releasably supported by the attaching device 50 in a separated manner in individual necktie locations.

Referring now to FIG. 2, there is shown the label 24 in greater detail. The label 24 has, on the front side, printed garment indicia generally indicated at 40 which indicate suitable combinations of color and pattern coordination of various articles of wearing apparel. The garment indicia includes suit indicia 46, shirt indicia 42, necktie indicia 44 and occasion indicia 48. Each one of the indicia is in the form of printing configured in the form of information used in coordinating the wearing apparel.

The garment indicia of the label 24 help the user in the actual coordination of the wearing apparel. The suit indicia 46 is disposed at the upper part of the label 24 in FIG. 2, and is configured as "Mr. Smith's Suit No.

6—solid navy." Thus, indicia 46 identifies or indicates a particular suit hanging on hanger 12.

With a given suit, various shirts, such as those identified by the shirt indicia 42, can be coordinated with individual ties. The shirt indicia 42 includes four columns of individual shirt column indicia 42A, 42B, 42C and 42D.

Each shirt column indicia, such as shirt column indicia 42A, is configured in the form of information designating several, preferably three types of shirts as shown in FIG. 2, the shirts are designed "6A1—white," "6A-2—blue button down" and "6A3—yellow."

Disposed beneath the shirt column indicia is the occasion indicia 48 which is configured in the form of information designating four different occasions for which the shirts and neckties are to be worn with the suit "No. 6."

Under each occasion indicia, there is one of the necktie indicia 44, which include individual necktie indicia 44A, 44B, 44C and 44D disposed at individual ones of the necktie locations of the necktie support device 50. In FIG. 2 for example, shirt column indicia 42A, designates a business occasion at individual occasion indicia 48A, that necktie is identified as necktie 6A.

Individual shirt column indicia 42B identifies three shirts, as "6B1," "6B2" and "6B3," which are suitable for formal occasions and match both the necktie designated 6B and the solid navy suit designated as No. 6. Individual shirt column indicia 42C indicates shirts that are suitable for informal occasions and that match both the necktie designated 6C and the solid navy suit designated as No. 6.

Figure 3:
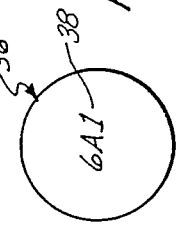
FIG. 3 is the front view of the shirt label sticker.

As shown in FIG. 3, a shirt label sticker 36 bears indicia 38 for easy identification of the shirt. The sticker 36 has an adhesive back side (not shown) by which the sticker is attached to the inner collar or other convenient part of the shirt (not shown) for easy identification purposes.

In the central portion of the front side of the sticker 36 there is the actual identification letter and number indicia 88 configured in the shape of shirt identity information. In FIG. 3, the sticker identifies the first shirt from column 42A. Each shirt (not shown) has a sticker with its own identification.

A similar sticker (not shown) is attached to each necktie for easy identification prior to the use or following the cleaning thereof.

In accordance with the present invention, the garment indicia 40 is configured and arranged to provide information for encoding the various items of wearing apparel for easy identification. In this regard, the suit number (e.g., 6) is used as the first character of the designation for both the shirts and ties coordinated with this suit. Also, each one of the shirts has its designation include the designation of the coordinated tie. Thus, for example, each one of the shirts associated with the tie designated as "6A", starts with the characters "6A". Thus, such a numbering scheme enables convenient inventory tracking, and lends itself to computerized information storage and retrieval.

In the actual use, according to the method of the invention, one wearing apparel coordinating system is used with each suit in the user's wardrobe. The suit, shirts and neckties may be chosen by the sales personnel of the apparel shop at the time of purchase of the suit. Such personnel possesses the expertise in coordinating the wearing apparel, and such personnel then fills in the label 24 with the appropriate identification of the shirts and neckties, which are selected as to be suitable and properly coordinated for each particular occasion for a given suit.

When the customer in the shop selects a suit of his or her own choice, the sales personnel selects certain color coordinated shirts, preferably three for each occasion, and attach the stickers, such as the sticker 36, to identify these shirts and enter the shirt identification information into the appropriate column on the label. Thus, for example, for business occasions, there would be three shirts and a matching necktie with each suit.

For formal occasions, column 42B identifies three shirts, 6B1, 6B2 and 6B3, and a matching necktie. For informal occasions, there is still another column of shirts 42C which is coordinated with a matching necktie 6C. Yet another column of shirts 42D is used to designate a matching necktie 6D, which is suitable for wearing at any or all occasions.

The plate is then attached to the hanger 12 on which the suit is then hung. In the event that the user's wardrobe is to be updated, the customer brings the wearing apparel coordinating plate, with or without the suit, to the apparel shop. In the event that the customer was returning to the apparel shop where the suit at hand was originally purchased, then such a shop may have entered into its computer all the pertinent information necessary to replenish the depleted shirt or tie supply. The shop then is conveniently able to suggest or substitute worn out or otherwise damaged or destroyed shirts and/or ties to be coordinated with the suit.

At home, for easy use, the person using the wearing apparel coordinator simply selects a desired suit for the occasion at hand, or a suit which would be his or her particular choice for that day. Then, after choosing the suit, he or she would look at the column indicating the occasion at hand and then select a shirt from that column. The necktie for that occasion is conveniently supported adjacent to the designated column, and he or she then has perfectly coordinated wearing apparel for that particular occasion.

For the other occasions, the wearer performs a similar operation. If the occasion requires business attire, then the wearer selects a shirt and necktie from the business column. If the occasion requires formal attire, the wearer selects a shirt and necktie from the formal column.

There are several advantages associated with the use of the system 10 of this invention. Firstly, the selection process is greatly simplified for the person who has little or no time, or does not have sufficiently developed taste to coordinate appropriate garments for particular occasions in a proper manner. Secondly, the system 10 maintains the closet (not shown) and/or dresser (not shown) organized in such a manner that the suits are stored together with the neckties coordinated therewith, in a convenient, compact manner. The coordinated shirts are then organized in the closet and/or dresser according to the column listed on the label of the plate. The shirts are labeled with the sticker for convenient identification so that they can be hung side by side on hangers, or otherwise stored, in a certain sequence or organized in any other way that is in accordance with the indicia o the wearing apparel coordinator plate with each suit.

Another advantage of the system 10 of this invention is that the wearing of the shirts, suits and ties is distributed evenly and uniformly. This would prevent the premature wear and tear of certain garments, in particular shirts, while leaving other garments unused, either because they are not noticed, they are hidden or they are not particularly preferred by the wearer. In this manner the clothes last longer. The person selects quite easily the particular colors and patterns which complement each other, and which are properly coordinated and are always appropriately dressed for any given occasion.

This invention would also be useful for the garment shops. The shop could monitor its customers' purchases on a computer (not shown) or in the log book (not shown). When the customer wishes to replenish or update his or her wardrobe, the shop is able to coordinate current purchases with previous purchases, so that the wardrobe is properly coordinated and maintained.

The shop attendant has stored information as to all suits, shirts and ties previously purchased from that shop, or any previously purchased garments, so that the shop personnel would be able to supplement, suggest or advise the customer about new fashions, new patterns, fashionable colors, or the like, at any given time.

While a particular embodiment of the present invention has been disclosed, it is to be understood that various different modifications are possible and are contemplated within the true spirit and scope of the appended claims. For example, instead of having the plate detachably mounted to a conventional clothes hanger, the inventive plate can be integrally formed as a part of the hanger itself. There is no intention, therefore, of limitations to the exact abstract or disclosure herein presented.

What is claimed is:

1. A wearing apparel coordinator for a jacket and trouser clothing hanger having a support hook thereon comprising:

plate means having a loop affixed to said plate means at a top portion thereof for surrounding the support hook of the clothing hanger to support said plate means from the hanger in a vertical depending manner in a plane substantially parallel to the plane of the hanger, enclosed within a jacket supported on the hanger, and for permitting the displacement of said plate means away from the hanger to allow a user to remove or replace a pair of trousers off of or onto the hanger while maintaining said plate means attached to and supported by the hanger, said loop being dimensioned to cause said plate means to be positioned near the support hook in a position exposed at least partially to the view of the user while the jacket encloses said plate means, said plate means having support means for attaching releasably a group of neckties or the like in a predetermined spaced apart manner; and garment indicia means disposed adjacent to said support means for displaying to the user an apparel coordination scheme to assist the user in selecting coordinated garments to be worn with a jacket and trousers or the like supported on the clothing hanger and corresponding to each individual necktie being attached to said plate means at an individual necktie location.

2. The article of claim 1, wherein indicia means is configured in the shape of a garment coordination information arranged in columns and rows.

3. The article of claim 1, wherein said indicia means includes occasion indicia means configured in the shape of information indicating when certain combinations of garments should be worn.

4. The article of claim 1, wherein said indicia means includes suit indicia means configured in the shape of information indicating the type of suit being supported by the hanger.

5. The article of claim 4, wherein said support means includes slot means through which the neckties are threaded.

6. The plate of claim 5, wherein said slot means includes a series of individual slots arranged side-by-side in a row to hold the neckties.

7. The article of claim 1, wherein said indicia means includes a label having printed indicia on the front face thereof.

8. The article of claim 1, wherein said indicia includes business indicia means, formal indicia means, informal indicia means and all occasions indicia means, each one of the last-mentioned four indicia means being disposed adjacent to individual ones of said necktie locations.

9. The article of claim 1, further including sticker means to be attached to garments designated by said indicia means, said sticker means having individual garment indicia means corresponding to said garment indicia means for identifying individual garments.

10. The article of claim 1, wherein said plate includes attaching means for mounting the plate to the clothes hanger.

11. The article of claim 10, wherein said attaching means includes a flexible loop affixed to said plate, the hanger having a hook, said loop for encircling the hook.

12. The article of claim 11, wherein said plate is composed of plastic material

13. A method of assisting a person in selecting coordinated wearing apparel to be worn with a jacket and trousers or the like supported on a clothing hanger having a support hook thereon comprising:

using a plate means having a loop, support means, and garment indicia therein to display an apparel coordination scheme for use with the jacket and trousers;

affixing said loop onto said support hook to position said plate means in a vertical plane substantially parallel to the plane of the clothing hanger encircled by said jacket and with said garment indicia exposed to view of a user; and securing one or more neckties to said plate means adjacent to said garment indicia.

* * * * *

UNITED STATES PATENT AND TRADEMARK OFFICE

CERTIFICATE OF CORRECTION

PATENT NO. : 4,791, 743

DATED : Dec. 20, 1988

INVENTOR(S) : Bernard L. Kleinke

It is certified that error appears in the above-identified patent and that said Letters Patent is hereby corrected as shown below:

| | | |
|---|---|---|
| Abstract | line 1, | after "apparel", please delete "device". and substitute therefor -- coordinating system, --. |
| Column 2, line 39 | | after "plate", please delete "00", and substitute therefor -- 30 --. |
| Column 3, line 41 | | after "indicia", please delete "88". and substitute therefore -- 38 --. |
| Column 4, line 63 | | after "indicia", please delete "0", and substitute therefore -- on --. |
| Column 6, line 42 | | after "material", please insert -- . --. |

Signed and Sealed this

Sixth Day of June, 1989

*Attest:*

DONALD J. QUIGG

*Attesting Officer*

*Commissioner of Patents and Trademarks*